US006964105B2

(12) United States Patent
McLeod

(10) Patent No.: US 6,964,105 B2
(45) Date of Patent: Nov. 15, 2005

(54) ADJUSTABLE COUNTERWEIGHT PENDULUM BOW SIGHT

(76) Inventor: Mark C. McLeod, 10169 Lynch La., Bastrop, LA (US) 71220

( * ) Notice: Subject to any disclaimer, the term of this patent is extended or adjusted under 35 U.S.C. 154(b) by 0 days.

(21) Appl. No.: 10/744,181

(22) Filed: Dec. 23, 2003

(65) Prior Publication Data

US 2005/0132588 A1 Jun. 23, 2005

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | | |
|---|---|---|---|---|---|
| 4,417,403 | A | | 11/1983 | Strange | 33/265 |
| 4,711,036 | A | * | 12/1987 | Morris | 33/265 |
| 5,025,565 | A | | 6/1991 | Stenerson | 33/265 |
| 5,050,576 | A | | 9/1991 | Larson | 124/87 |
| 5,253,423 | A | | 10/1993 | Sullivan, Jr. | 33/265 |
| 5,339,227 | A | | 8/1994 | Jones | 362/109 |
| 5,341,791 | A | | 8/1994 | Shafer | 124/87 |
| 5,347,722 | A | * | 9/1994 | Sefsick | 33/265 |
| 5,379,747 | A | | 1/1995 | Morris | 124/87 |
| 5,524,351 | A | | 6/1996 | Pinson et al. | 33/265 |
| 5,819,423 | A | | 10/1998 | Kamola | 33/265 |
| RE36,266 | E | * | 8/1999 | Gibbs | 33/265 |
| 6,079,111 | A | * | 6/2000 | Williams et al. | 33/265 |
| 6,082,012 | A | | 7/2000 | McLeod | 33/265 |
| 6,430,821 | B1 | * | 8/2002 | Cionni | 33/265 |
| 6,477,779 | B1 | * | 11/2002 | Slates | 33/265 |

* cited by examiner

*Primary Examiner*—Christopher W. Fulton
*Assistant Examiner*—Amy R. Cohen
(74) *Attorney, Agent, or Firm*—John M. Harrison

(57) ABSTRACT

An adjustable counterweight pendulum bow sight which is fitted with a sight ring having monofilament crosshairs and optionally provided with a source of black light or alternative target enhancing devices such as fiber optic systems, for illuminating the sight ring area under conditions of low lighting. The pendulum bow sight is mounted to a bow in pivoting fashion and includes a pendulum bracket fitted with adjustable counterweights of various design, facilitating convenient and accurate sighting of the target in a direct line of sight, regardless of the elevation of the hunter. The sight ring in the pendulum bow sight is mounted on the pendulum bracket, which is pivotally and adjustably attached to a frame mounted on the bow. The pendulum bracket and thus, the sight ring, may be stabilized by operation of a stabilizing pin and supported in a limited pivoting configuration with respect to the frame, by means of a pendulum bracket support.

17 Claims, 3 Drawing Sheets

ADJUSTABLE COUNTERWEIGHT PENDULUM BOW SIGHT

SUMMARY OF THE INVENTION

This invention is characterized by an adjustable counterweight pendulum bow sight having a relatively large sight ring fitted with optional light-enhancing devices such as fiber-optic fibers or monofilament crosshairs of selected, typically bright, fluorescent color. The sight ring is fixed to an adjustable pendulum having various adjustable counterweights and an optional black light source for illuminating the crosshairs in conditions of low light, such as early morning and late evening, to extend hunting time. The adjustable pendulum is pivotally and adjustably attached to a mount plate connected to the bow frame. The sight ring is so mounted as to facilitate horizontal orientation of the sight ring regardless of the elevation of the bow and the hunter and the pendulum includes screw-operated or sliding pendulum weights for balancing the pendulum in a desired pivoted orientation regardless of the position of the hunter. Stabilizing and bracket support pins are also extended from the mount plate for optional engagement with the adjustable counterweight pendulum to respectively stabilize and support the pendulum and sight ring in any desired position. A sight guard may be attached to the mount plate and extends around the pendulum bow sight for protecting the pendulum bow sight and optionally mounting a light-gathering optic fiber or fibers or a black light source.

BRIEF DESCRIPTION OF THE DRAWINGS

The invention will be better understood by reference to the accompanying drawings wherein.

DESCRIPTION OF THE PREFERRED EMBODIMENTS

Figures 1, 2, 3:
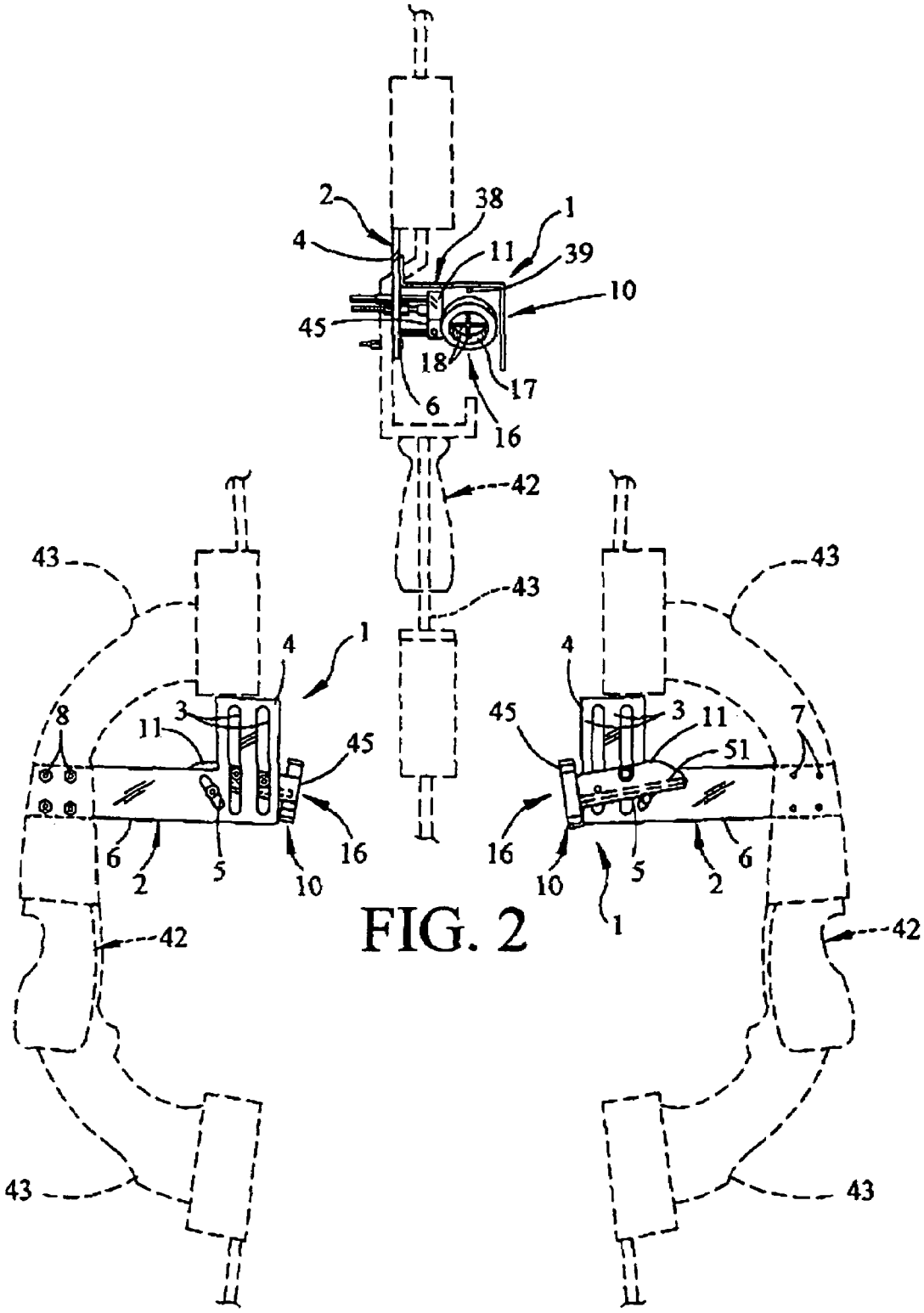
FIG. 1 is a left side view of the adjustable counterweight pendulum bow sight embodiment of this invention mounted in functional position on a bow and featuring a screw-operated counterweight.
FIG. 2 is a front view of the adjustable counterweight pendulum bow sight and bow illustrated in FIG. 1, with an optional sight guard for protecting the pendulum bow sight, a sight ring with fluorescent crosshairs and a source of black light.
FIG. 3 is a right side view of the adjustable counterweight pendulum bow sight and bow illustrated in FIGS. 1 and 2.
Figure 4:
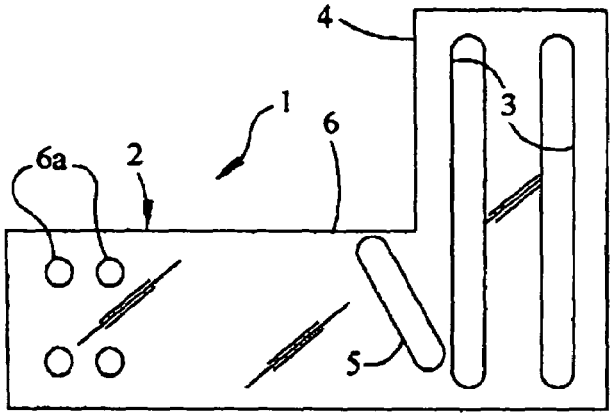
FIG. 4 is a side view of a typical mount plate for fixed attachment to the frame of a bow and mounting the sight pendulum and sight ring elements of the adjustable counterweight pendulum bow sight illustrated in FIGS. 1–3.

Referring initially to FIGS. 1–3, 4–6, 8 and 9 of the drawings, in a first preferred embodiment of the invention an adjustable counterweight pendulum bow sight is generally illustrated by reference numeral 1. The adjustable counterweight pendulum bow sight 1 includes an L-shaped mount plate 2, characterized by parallel pendulum mount slots 3, provided in a pendulum mount leg 4 and extending into the bow mount leg 6 of the mount plate 2, illustrated in FIG. 4. A support pin slot 5 is also provided in the bow mount leg 6 in angular relationship with respect to the typically parallel pendulum mount slots 3. Mount leg openings 6*a* are provided in spaced-apart relationship with respect to each other in the extending end of the bow mount leg 6, as further illustrated in FIG. 4, to accommodate bow mount bolts 7 (FIGS. 3 and 9) for fixedly attaching the bow mount leg 6 of the mount plate 2 to the bow arm 43 of a bow 42 (illustrated in phantom). It will be appreciated by those skilled in the art that the bow 42 may be either a compound bow or a recurve bow, as desired, although the adjustable counterweight pendulum bow sight 1 is primarily designed for use with compound bows. The bow mount bolts 7 may be threaded into existing drilled and tapped openings (not illustrated) provided in the bow frame 43 of the bow 42, or the mount plate 2 may be secured in place by threading mount nuts 8 on the bow mount bolts 7, as illustrated in FIG. 1.

Figure 6:
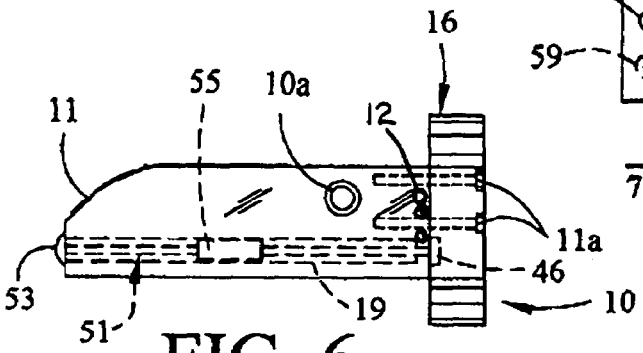
FIG. 6 is a side view of the sight ring and screw-operated counterweight pendulum elements of the adjustable counterweight pendulum illustrated in FIG. 5.
Figure 8:
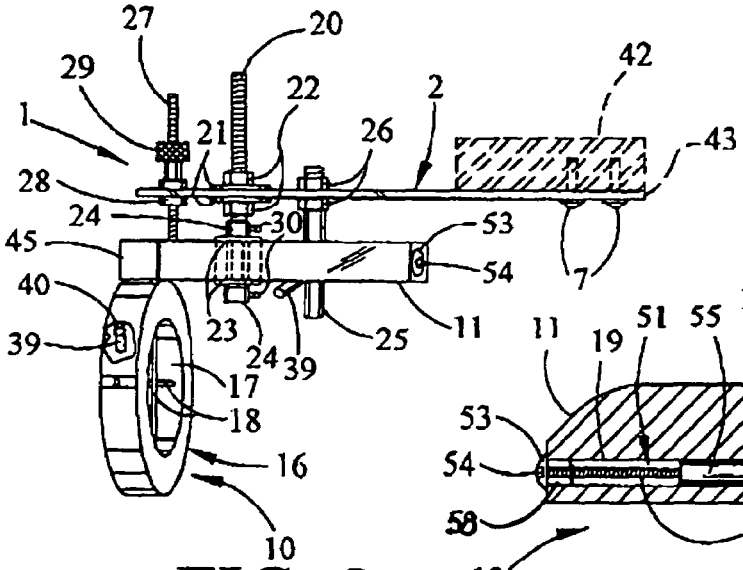
FIG. 8 is a top view of the adjustable counterweight pendulum bow sight illustrated in FIGS. 1–3, fitted with a sight ring having fluorescent monofilament crosshairs and a black light for illuminating the crosshairs.
Figure 7:
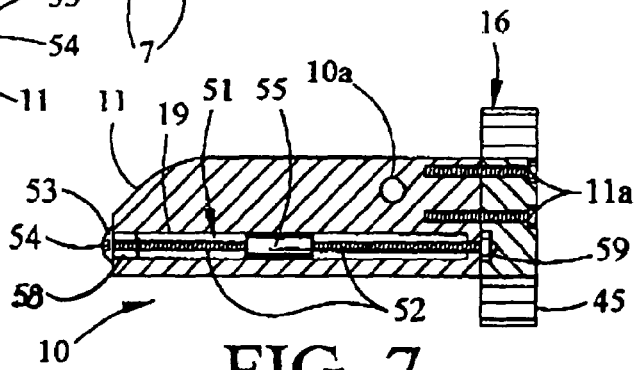
FIG. 7 is a longitudinal sectional view of the screw-operated counterweight embodiment of the adjustable counterweight pendulum bow sight illustrated in FIG. 6.
Figure 10:
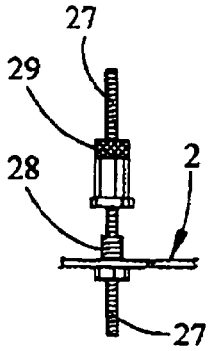
FIG. 10 is a top view of a typical stabilizing pin mount assembly for mounting the stabilizing pin in the mount plate illustrated in FIG. 9.
Figure 9:
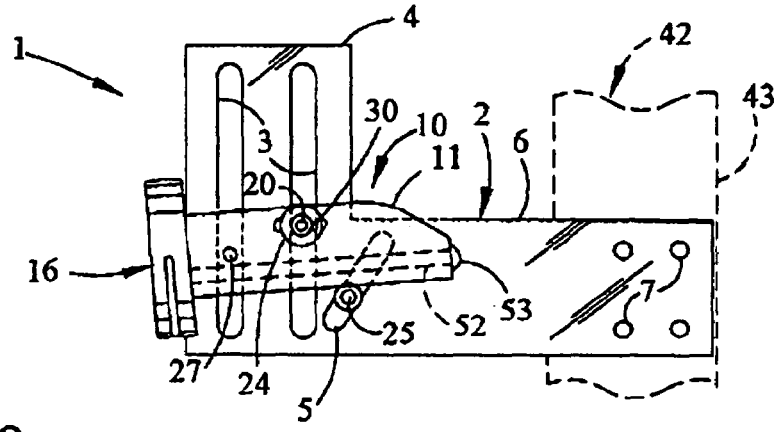
FIG. 9 is a side view of the adjustable counterweight pendulum bow sight illustrated in FIG. 8, including a typical stabilizing pin assembly for mounting on the mount plate illustrated in FIG. 2 and engaging the pendulum element of the adjustable counterweight pendulum bow sight illustrated in FIGS. 1–3 and 8.

An adjustable pendulum 10 includes a pendulum bracket 11, fitted with pendulum adjusting openings 12, as illustrated in FIGS. 6 and 7. The adjustable pendulum 10 is adjustably and pivotally connected to the mount plate 2 at a pendulum mount slot 3 by means of a threaded pendulum pivot pin 20, extending transversely through a pivot opening 10*a* in the pendulum bracket 11 and typically including plate washers 21 and pivot pin nuts 22 for securing the pendulum pivot pin 20 to the mount plate 2, as illustrated in FIG. 8. Bracket washers 23 and bracket collars 24, fitted with allen screws 30, typically serve to attach the pendulum bracket 11 to the threaded pendulum pivot pin 20 at the pivot opening 10*a*, as further illustrated in FIG. 8. A bushing may be provided on the pendulum pivot pin 20 at the pendulum mount slot 3 in pendulum bracket 11, if desired. Accordingly, it will be appreciated from a consideration of FIGS. 8 and 9 that the pendulum bracket 11 is pivotally mounted with respect to the mount plate 2 and is spaced from the mount plate 2, as particularly illustrated in FIG. 8.

Figure 5:
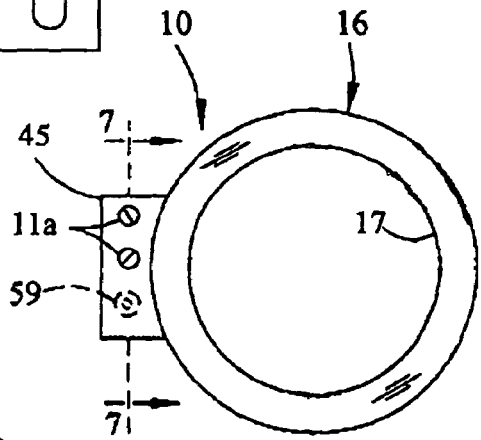
FIG. 5 is a front view of an open sight ring and screw-operated counterweight pendulum elements of the adjustable counterweight pendulum bow sight illustrated in FIGS. 1–3.

A sight ring 16 is fixed to a pendulum bracket plate 45, fixed to or shaped integrally with one end of the pendulum bracket 11, by means of ring bolts or screws 11*a*, as illustrated in FIG. 5. The sight ring 16 is preferably circular in configuration and may be fitted with typically blue or yellow fluorescent monofilament crosshairs 18, extending across the diameter of the ring aperture 17 of the sight ring 16 in crossed relationship, as further illustrated in FIGS. 2 and 8. Alternatively, any desired vision-enhancing device such as a light-gathering optic fiber or fibers in fiber-optic systems or the like, can be provided in the ring aperture 17 of the sight ring 16, as desired.

As illustrated in FIGS. 6 and 7 of the drawings a screw-operated counterweight 55 is typically provided in the bottom longitudinal segment of the top pendulum bracket 11 adjacent to the sight ring 16, for balancing the pendulum bracket 11 in a desired pivoting position, as hereinafter further described. A threaded stabilizing pin 27 is adjustably attached to the mount plate 2 at the front one of the pendulum mount slots 3 by means of a stabilizing pin mount 28 and a knurled mount nut 29, as illustrated in FIGS. 8–11. Accordingly, the pivoting function of the adjustable pendulum 10 with respect to the mount plate 2 and the bow 42 may be arrested and stabilized by threading the stabilizing pin 27 through the internally-threaded stabilizing pin mount 28 after loosening the mount nut 29 on the stabilizing pin mount 28, such that the extending end of the stabilizing pin 27 projects through a selected one of the pendulum adjusting openings 12, provided in the pendulum bracket 11 of the adjustable pendulum 10, (FIG. 6).

As illustrated in FIG. 2 of the drawings, a sight guard 38 may be bolted or otherwise attached to the mount plate 2 and extended over and at least partially around the adjustable counterweight pendulum bow sight 1 for protection of the adjustable counterweight pendulum bow sight 1. A black light source 39 can also be mounted on the sight guard 38 and fitted with a battery 40 and associated wiring (not illustrated) to facilitate focusing the black light source 39 on the crosshairs 18 in the sight ring 16, as hereinafter further described with respect to FIGS. 2 and 8 of the drawings.

Figure 12:
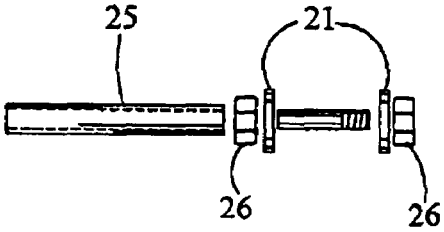
FIG. 12 is an exploded view of a typical pin bracket support element attached to the mount plate illustrated in FIG. 4 for supporting the adjustable counterweight pendulum bow sight under certain conditions of use, as illustrated in FIGS. 1–3, 8 and 9.
Figure 11:
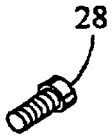
FIG. 11 is a perspective view of a typical stabilizing pin mount in the stabilizing pin mount assembly illustrated in FIG. 10.

Referring again to FIGS. 8, 9 and 12 of the drawings, a pendulum bracket support 25 is also typically adjustably attached to the mount plate 2 in the support pin slot 5 by means of support pin nuts 26 and corresponding optional plate washers 21. The function of the pendulum bracket support 25 is to support the pendulum bracket 11 such that the adjustable pendulum 10 pivots to a desired limited extent on the pendulum pivot pin 20, as further hereinafter described.

Referring now to FIGS. 5, 6 and 8 of the drawings, in a preferred embodiment of the invention the black light source 39, typically powered by a battery 40, is typically seated in the sight ring 16 (FIGS. 5 and 8) or in the pendulum bracket 11 for illuminating the fluorescent monofilament crosshairs 18 in conditions of low light, such as early morning and late evening, to prolong hunting time. Alternatively, the black light source 39 and battery 40 can be mounted on the sight guard 38, as illustrated in FIG. 2 and heretofore described. The black light source 39 may be of any desired design well known to those skilled in the art, emitting a beam of invisible ultraviolet or infrared light, and it has been found that subjecting the diametric fluorescent monofilament crosshairs 18, which may be of any desired fluorescent color such as yellow, blue or the like, to the beam of black light, effects a luminous glow along the crossed axis of the crosshairs 18 and thus facilitates surprisingly good sighting conditions in the conditions of low light. Although the black light source 39 and wafer battery 40 may be mounted in the sight ring 16 and (optionally) the pendulum bracket 11, it will be appreciated that these elements may be mounted in any desired location, including on the bow 42 itself or on any bow accessory element such as a bracket plate or the like, as heretofore described, for focusing the black light beam in the fluorescent monofilament crosshairs 18.

Referring to FIGS. 1–3 and 5–7 of the drawings, in a preferred embodiment of the invention the adjustable counterweight element used in the pendulum bow sight 10 is characterized by a screw-operated counterweight 55, mounted on a threaded screw 51 having one end seated in a pendulum bracket plate 45. The pendulum bracket 45 is typically shaped integrally with the sight ring 16 and features a plate countersink 46 in the inside surface thereof, as illustrated in FIGS. 7 and 7A. A pair of plate mount openings 47 are provided in the pendulum bracket plate 45 for receiving corresponding plate mount bolts or screws 48 that serve to removably mount the pendulum bracket plate 45 and the sight ring 16 on the pendulum bracket 11 by threading the respective mount bolts or screws 48 in the typically internally-threaded pendulum openings 49 provided in the adjacent end of the pendulum bracket 11. A pendulum bore 19 extends longitudinally through the pendulum bracket 11 and ends in spaced-apart relationship with respect to the plate countersink 46 in the pendulum bracket plate 45, as further illustrated in FIGS. 7 and 7A. The threaded screw 51 extends through the pendulum bore 19 and a nut 59 is threaded on the extending end of the threaded screw 51 and is seated thereon, typically with "lock tite", to prevent the nut 59 from rotating on the threaded end of the threaded screw 51 without the application of considerable force. The nut 59 is seated in the plate countersink 46 of the pendulum bracket plate 45 and the opposite end of the threaded screw 51 typically terminates in a hex or other drive (not illustrated) or a screw head 53, fitted with a drive receptacle 54, such as an allen screw receptacle or the like. Screw threads 52 of different pitch may be provided on the threaded screw 51 for receiving a weight 55, having a weight bore 56 provided with bore threads 57 that match the screw threads 52, to facilitate movement of the weight 55 along the length of the threaded screw 51 responsive to rotation of the threaded screw 51. This rotation is typically effected by inserting an appropriate driver (not illustrated) in the drive receptacle 54 of the screw head 53 and rotating the driver. A segment of rubber tubing 58 is typically provided on the threaded screw 51 adjacent to the screw head 53 to facilitate limiting the travel of the weight 55 on the threaded screw 51 as the weight 55 approaches the screw head 53 (FIG. 7). Accordingly, it will be appreciated that for any position of the hunter at any desired elevation, the counterweight characteristics of the adjustable pendulum 10 can be altered by inserting an appropriate driver in the drive receptacle 54 of the screw head 53, rotating the driver and the threaded screw 51 and causing the weight 55 to traverse the threaded screw 51 in either selected direction to adjust the balancing characteristics of the adjustable pendulum 10 for the appropriate hunter elevation.

Figure 13:
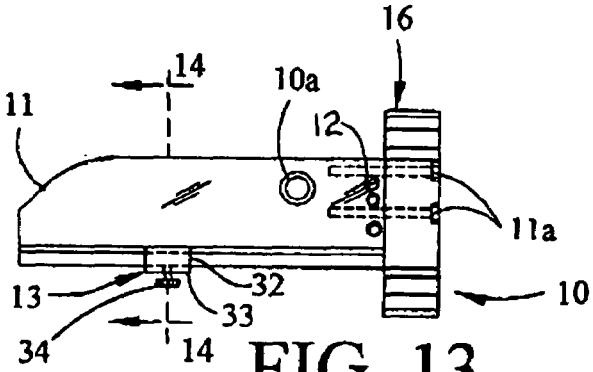
FIG. 13 is a side view of a slide counterweight for use in the adjustable counterweight pendulum bow sight.
Figure 14:
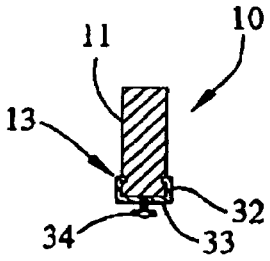
FIG. 14 is a sectional view, taken along line 14—14 of the slide counterweight illustrated in FIG. 13.

In another preferred embodiment of the invention, and referring to FIGS. 13 and 14 of the drawings, the adjustable counterweight includes a grooved slide weight 13, fitted to a pair of parallel pendulum bracket grooves 31, provided longitudinally on opposite surfaces of the pendulum bracket 11 by means of slide weight fingers 32. The slide weight fingers 32 extend from, or are shaped integrally with, a slide weight plate 33 positioned beneath the pendulum bracket 11 and a slide weight adjusting screw 34 extends through the slide weight plate 33 for selectively contacting the bottom of the pendulum bracket 11 and adjusting the grooved slide weight 13 in any desired position along the length of the pendulum bracket grooves 31 by application and release of pressure on the adjusting screw 34.

Figure 15:
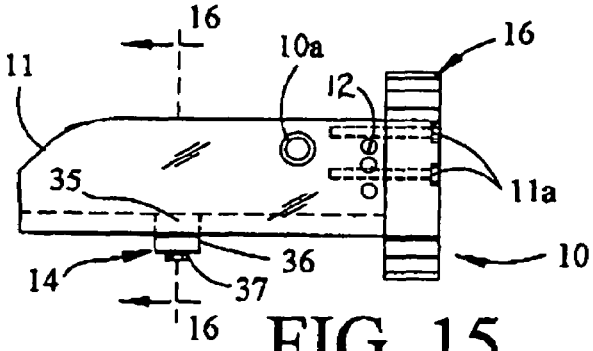
FIG. 15 is a side view of a dovetail counterweight for use in the adjustable counterweight pendulum bow sight.
Figure 16:
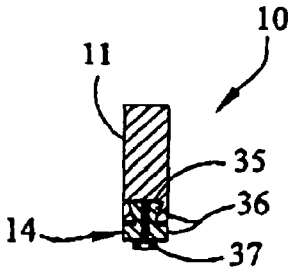
FIG. 16 is a sectional view, taken along line 16—16 of the dovetail counterweight illustrated in FIG. 15.

Referring now to FIGS. 15 and 16 of the drawings, in yet another preferred embodiment of the invention the adjustable counterweight is characterized by a dovetail slot weight 14. The dovetail slide weight 13 includes a dovetail weight 36 that fits in a correspondingly-shaped pendulum dovetail slot 35, longitudinally cut or molded in the bottom of the pendulum bracket 11, to facilitate sliding of the dovetail slide weight 14 along the length of the pendulum bracket 11. A dovetail slide weight adjusting screw 37 is threaded into the dovetail slide weight 36 to facilitate selectively contacting the bottom of the pendulum bracket 11 and immobilizing the dovetail weight 36 at any point in its traverse of the pendulum bracket 11 and balancing the adjustable pendulum 10 as desired.

In operation, the adjustable counterweight pendulum bow sight 1 of this invention is utilized as follows: the mount plate 2 of the adjustable counterweight pendulum bow sight 1 is attached to the bow frame 43 of the bow 42 using the bow mount bolts 7 as illustrated in FIG. 8, or the bow mount bolts 7 may be used in combination with the corresponding mount nuts 8, as illustrated in FIGS. 1 and 3 of the drawings. The pendulum bracket 11 of the adjustable pendulum 10 is then pivotally attached to the inside pendulum mount slot of the mount plate 2 using the pivot mount nuts 22, as described above, such that the pendulum bracket 11 pivots on the pendulum pivot pin 20 and facilitates sighting through the sight ring 16 toward a target. The line of sight can be quickly and easily effected regardless of the elevation of the bow and the hunter due to the pivoting function of the sight pendulum 10 of the pendulum bow sight 1, wherein the sight ring 16 always maintains a horizontal alignment, regardless of the relative position of the bow 42. This line of sight, at any elevation and pivoting angle of the adjustable pendulum 10, is stabilized and made more accurate by adjustment of the threaded screw 51 in the screw-operated counterweight 55, the grooved slide weight 13 or the dovetail slide weight 14, as heretofore described. For example, movement of the weight forwardly away from the sight ring 16 causes the arc of the line of sight to increase, which facilitates greater accuracy at longer distances. Under circumstances where it is desired to fix the sight ring 16 in position with respect to the bow 42, the stabilizing pin 27 can be adjustably inserted into a selected one of the pendulum adjusting openings 12 in the pendulum bracket 11, responsive to loosening of the mount nut 29 on the corresponding stabilizing pin mount 28, as heretofore described. The adjustable pendulum 10 is now fixed with respect to the bow 42 and sighting can be accomplished without free pivoting of the adjustable pendulum 10. The pendulum bracket support 25 can also be utilized under circumstances where it is desired to facilitate pivoting of the adjustable pendulum 10 with respect to the mount plate 2 and the bow 42 in limited fashion and to limit downward extension of the pendulum bracket 11 past a predetermined point determined by the position of the pendulum bracket support 25 in the support pin slot 5, illustrated in FIG. 4 of the drawings.

While the preferred material for use as the crosshairs 18 in the sight ring 16 illustrated in FIGS. 2 and 8 is fluorescent monofilament line of selected color and diameter, it will be appreciated that other materials may also be used, as desired. The fluorescent monofilament line provides a superior viewing of the crosshairs 18, particularly under circumstances where the line is yellow, and when a black light source 39 is provided in the sight ring 16, on the pendulum bracket 11, the sight guard 38 or otherwise located to focus on the crosshairs 18, as heretofore described. Other vision-enhancing devices, including fiber-optic devices and the like can be installed in the ring aperture 17 of the sight ring 16 (FIG. 5), according to the knowledge of those skilled in the art.

It will be appreciated by those skilled in the art that the adjustable counterweight pendulum bow sight of this invention can be utilized in bows of various design, but are particularly useful in compound bows, where the arrows are shot with great power and precision. The respective parts or elements of the adjustable counterweight pendulum bow sight may typically be constructed of easily moldable material, such as plastic.

While the preferred embodiments of the invention have been described above, it will be recognized and understood that various modifications may be made in the invention and the appended claims are intended to cover all such modifications which may fall within the spirit and scope of the invention.

What is claimed is:

1. An adjustable pendulum bow sight for a bow, comprising a bracket for attachment to the bow; a pendulum pivotally carried by said bracket; a threaded screw longitudinally and rotatably provided in said pendulum; a counterweight threadably seated on the threaded screw for linear longitudinal adjustment in said pendulum responsive to rotation of said threaded screw; a drive provided on said threaded screw for receiving a driver and causing said rotation of said threaded screw; and a sight ring fixed to said pendulum, said sight ring disposed in a selected line-of-sight when the bow is positioned for releasing an arrow toward a target.

2. The adjustable pendulum bow sight of claim 1 comprising monofilament crosshairs provided on said sight ring for viewing the target through said sight ring.

3. The adjustable pendulum bow sight of claim 2 wherein said monofilament crosshairs are characterized by at least one fluorescent color.

4. The adjustable pendulum bow sight of claim 3 comprising a source of black light mounted in said sight ring for illuminating said monofilament crosshairs with the black light.

5. The adjustable pendulum bow sight of claim 1 comprising a support pin carried by said bracket and extending beneath said pendulum for limiting the pivot of said pendulum and a stabilizing pin carried by said bracket and at least one pendulum adjusting opening provided in said pendulum for receiving said stabilizing pin and fixing said pendulum in a selected degree of pivot.

6. The adjustable pendulum bow sight of claim 5 comprising monofilament crosshairs characterized by at least one fluorescent color provided on said sight ring for viewing the target through said sight ring and comprising a source of black light mounted in said sight ring for illuminating said monofilament crosshairs with the black light.

7. An adjustable pendulum bow sight for a bow, comprising a bracket for attachment to the bow; a pendulum pivotally carried by said bracket; a counterweight slidably carried by said pendulum and a set screw threaded in said counterweight for selectively contacting said pendulum and immobilizing said counterweight on said pendulum; a sight ring fixed to said pendulum, said sight ring disposed in a selected line-of-sight when the bow is positioned for releasing an arrow toward a target; and a vision-enhancing device provided in said sight ring for enhancing the vision of the observer of the target.

8. The adjustable pendulum bow sight of claim 7 comprising a support pin carried by said bracket and extending beneath said pendulum for limiting the pivot of said pendulum.

9. The adjustable pendulum bow sight of claim 8 comprising a stabilizing pin carried by said bracket and at least one pendulum adjusting opening provided in said pendulum for receiving said stabilizing pin and immobilizing said pendulum in a selected degree of pivot.

10. An adjustable pendulum bow sight for a bow, comprising a bracket for attachment to the bow, a pendulum pivotally carried by said bracket; a threaded screw journalled for rotation in said pendulum; a counterweight threadably seated on the threaded screw for linear longitudinal adjustment and pivotal adjustment of the position of said pendulum with respect to the bow; and a sight ring fixed to said pendulum, said sight ring disposed in a selected line-of-sight when the bow is positioned for releasing an arrow toward a target.

11. The adjustable pendulum bow sight of claim 10 comprising a vision-enhancing device provided in said sight ring for enhancing the vision of the observer of the target.

12. The adjustable pendulum bow sight of claim 11 wherein said vision-enhancing device comprises monofilament crosshairs provided on said sight ring for viewing the target through said sight ring.

13. The adjustable pendulum bow sight of claim 12 wherein said monofilament crosshairs are characterized by at least one fluorescent color.

14. The adjustable pendulum bow sight of claim 13 comprising a source of black light mounted in said sight ring for illuminating said monofilament crosshairs with the black light.

15. An adjustable pendulum bow sight for a bow, comprising a bracket for attachment to the bow; a pendulum pivotally carried by said bracket; a threaded screw journalled for rotation in said pendulum; a counterweight threadably seated on the threaded screw for linear longitudinal adjustment and pivotal adjustment of the position of said pendulum with respect to the bow; a sight ring fixed to said pendulum, said sight ring disposed in a selected line-of-sight when the bow is positioned for releasing an arrow toward a target; and a vision-enhancing device provided in said sight ring for enhancing the vision of the observer of the target.

16. The adjustable pendulum bow sight of claim 15 comprising a support pin carried by said bracket and extending beneath said pendulum for limiting the pivot of said pendulum.

17. The adjustable pendulum bow sight of claim 16 comprising a stabilizing pin carried by said bracket and at least one pendulum adjusting opening provided in said pendulum for receiving said stabilizing pin and immobilizing said pendulum in a selected degree of pivot.

* * * * *